United States Patent [19]

Kluck

[11] 4,398,839

[45] Aug. 16, 1983

[54] DEPTH DISPLACEMENT SQUEEGEE WITH LOADING DEVICE

[76] Inventor: Robert S. Kluck, 14681 Pepper Tree Cir., Tustin, Calif. 92680

[21] Appl. No.: 255,060

[22] Filed: Apr. 17, 1981

[51] Int. Cl.[3] ..... A47L 13/30

[52] U.S. Cl. ..... 401/263; 15/244 R

[58] Field of Search ..... 401/139, 5, 193, 263; 15/244, 245, 169

[56] References Cited

U.S. PATENT DOCUMENTS

| | | | |
|---|---|---|---|
| 2,842,789 | 7/1958 | Wells | 15/245 |
| 3,059,262 | 10/1962 | Marchner | 15/244 R |
| 3,204,278 | 9/1965 | Lambros | 15/244 R |
| 3,334,792 | 8/1967 | De Vries et al. | 401/263 X |

*Primary Examiner*—Stephen C. Pellegrino

[57] ABSTRACT

Constituting a serrated or comb style squeegee blade that provides the depth displacement pressure required when applying a pattern to an irregular surface, such as a textured wall or ceiling, by means of a multi positional screen transfer device, the unit also incorporating a movable paint plough to sequentially advance a slow drying color medium paste to the forward top edge of the squeegee's serrated blade following each pass over the screen, thereby minimizing spillage and dripping when using the device in an overhead position. Additionally, a dispsensing device for easy loading of the color medium onto the squeegee's serrated blade when it is to be used in overhead applications.

5 Claims, 9 Drawing Figures

DEPTH DISPLACEMENT SQUEEGEE WITH LOADING DEVICE

BACKGROUND OF THE INVENTION

The present invention introduces a new concept in squeegee construction wherein for the first time full pattern screening of textured walls and ceilings can be executed.

The use and limitations of pattern transfer by screening methods are well known to the trade. The difficulty of obtaining full pattern definition when screening a textured, or similarly irregular surface is also well known, and represents a problem not satisfactorily solved even by spray techniques. Use of stenciling, a companion process, merely introduces longer application times, leads to frequent smears, and adds a stenciled appearance which can be overcome only by a time-consuming overlay process.

The present invention comprises a squeegee of serrated blade construction whose individual fingers throughout its width provide the depth displacement pressures required to force a color medium through a screen and into the valleys of a textured surface to which a decorative design is to be applied. In addition to overcoming plateau bridging introduced by a continuous blade squeegee, this unit incorporates a movable ram or dozer device for inching the color medium forward on the blade following each pass over a screen held in the overhead position.

The invention also comprises a separate dispensing reservoir for rapid loading of the color medium onto the squeegee blade when it is being used in the overhead mode.

It is accordingly an object of this invention to provide a device capable of applying completely defined patterns to rough surfaces heretofore found difficult to decorate by methods such as screening, stenciling, or in the case of walls and ceilings, even by wallpapering.

SUMMARY OF THE INVENTION

A multi functional five-part squeegee device, together with separate dispensing platen and color medium reservoir, constitutes the basis of the present invention. The squeegee comprises a frame whose primary function is to support a serrated squeegee blade, and secondarily to provide a platform on which a dozer device can slide to advance the color medium to the front contact edge of the blade. Additionally, the requirement for a squeegee blade to apply differential pressures across its width when screening uneven surfaces is met by independently moving serrated fingers on the forward edge of the blade. The function of the separate platen and paint reservoir is to facilitate loading of the squeegee blade when using it in the overhead mode.

Functionally, the frame accommodates a quick-disconnect handle, a replaceable squeegee blade, and a sliding dozer blade for paint advancement. The latter device can be easily removed for cleaning and replacement in case of breakage. When loaded with a thick, paste-like color medium, the squeegee is ready to apply screened patterns to such irregular surfaces as textured walls and ceilings. When sufficient screen interface pressure is applied by the depth displacement squeegee to cause the serrated blade elements to slip in conformance with the elevation differentials of the surface, the screen, and consequently the paint, is forced to follow the contours encountered.

A paint reservoir which slides between two rails and over a troughed platen surface constitutes the device for loading the squeegee blade when it is being used in the overhead position. As the reservoir is slid over the platen surface, a measured amount of paint is deposited into the trough which is subsequently wiped out by the squeegee blade.

BRIEF DESCRIPTION OF THE DRAWINGS

The detailed description of the invention which follows is referenced to the drawings wherein like character numbers refer to like parts throughout and which.

DETAILED DESCRIPTION

Figures 1, 2:
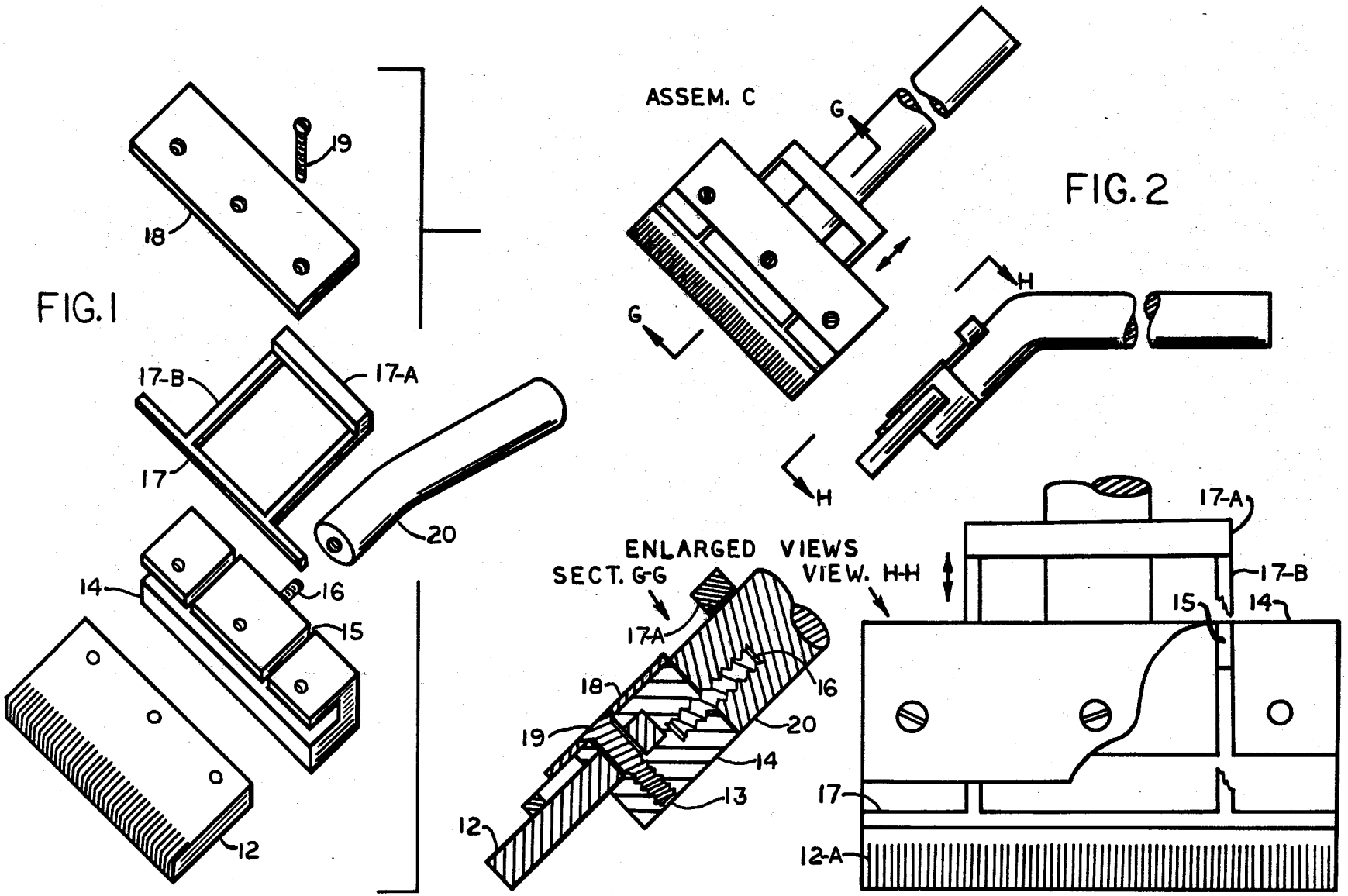
FIG. 1 is a pictorial view of various components, and FIG. 2 the assembled plan, side, and sectionalized views of the present invention.

Supportive Frame 14 of the present device is illustrated in FIGS. 1 and 2, and by sectionalized View G-G and H-H of FIG. 2. Three threaded Holes 13 through the base of Frame 14 provide the means for securing squeegee Blade 12, Plough 17, and Retainer Plate 18 to the frame by means of Screws 19. Bolt 16, imbedded on the back surface of Frame 14, provides the means for anchoring removable Handle 20 to the frame. Thumb Bar 17-A, sliding on Handle 20, provides the means for advancing Plough 17 along the upper edge of Squeegee Blade 12 as shown by assembly C of FIG. 2. Interconnecting Rails 17-B riding within Rectangular Slots 15, under Retainer Plate 18 of FIGS. 1 and 2, maintains alignment of the paint advancing Plough 17 as it slides forward. Section H-H of FIG. 2, illustrates that the Serrated Fingers 12-A are an integral part of squeegee Blade 12, and that their length approximates 20% of the blade's length.

Figure 5:
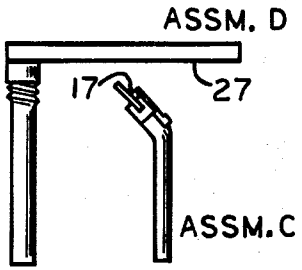
FIG. 5 is a side view of Assembly C when used in conjunction with Assembly D of multi positional transfer device, Ser. No. 154,062 for overhead application of designs to textured or rough surfaces.
Figure 3:
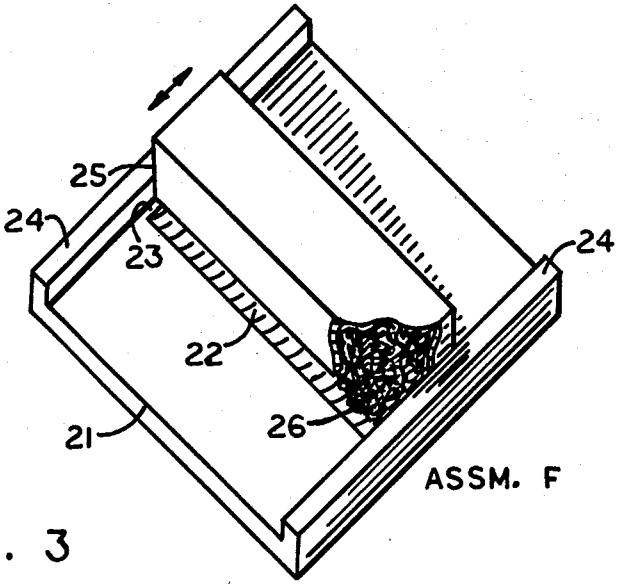
FIG. 3 presents a pictorial view, and assembly thereof of two companion parts that constitute a paint dispensing trough used in conjunction with the present invention.

To prepare the depth displacement squeegee for overhead application, a two-part paint dispensing device is used as illustrated by FIG. 3. After Box 25 is filled with a viscous slow-drying Paint 26, it is inverted between Guide Rails 24, and slid over Platen 21, to deposit a measured portion of paint in Trough 22. Bridges 23 on either side of Platen 21, stabilize Box 25 as it passes over Trough 22. Return of Box 25 to the rear of Platen 21 provides the room necessary for loading Squeegee Blade 12 as it is wiped through Trough 22 as shown in Assembly F of FIG. 3. Following trough loading, a multi-positional transfer device Assembly D Ser. No. (154,062) is used with the Squeegee Assembly C to transfer patterns to overhead surfaces as shown in FIG. 5. Following each wipe of the screen, paint is advanced to the forward edge of Squeegee Blade 12 by moving Plough 17 forward, followed by retraction.

Figure 4:
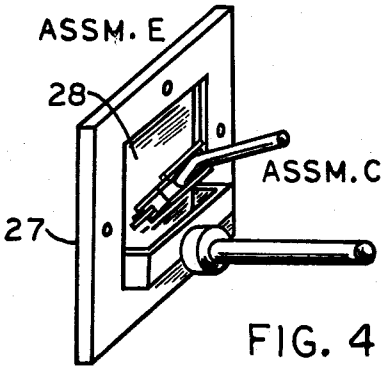
FIG. 4, in pictorial views, shows Assembly C of the present invention being used in conjunction with Assembly E of the multi positional transfer device described in Ser. No. 154,062 filed 5/28/80 for vertical application of a design to textured surfaces.

Transfer to vertical rough surfaces is accomplished by using Squeegee Assembly C with a multi-positional transfer device equipped with a paint hopper as per Assembly E Ser. No. 154,062) of FIG. 4. Re-loading following each wipe of the screen in this instance is accomplished by dipping Squeegee Blade 12 into the paint hopper of Assembly E rather than by a swipe through Trough 22 of Assembly F, FIG. 3. Paint advancement by Plough 17 of Assembly C is not required when performing vertical transfer with a hoppered Assembly E.

Figure 6:
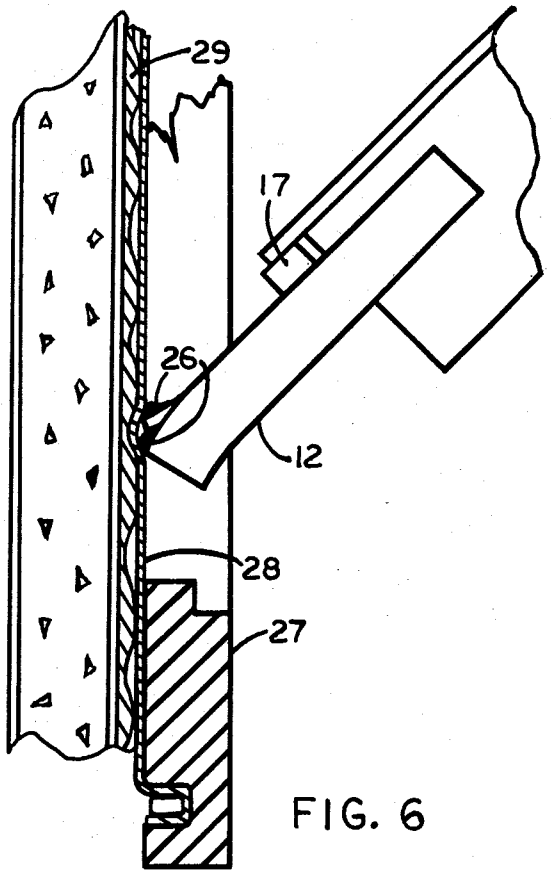
FIG. 6, represents a sectionalized view showing the finger action that occurs when a depth displacement squeegee is used to apply a screen design to an uneven surface.

FIG. 6 illustrates the depth displacement capabilities of Squeegee Blade 12 as it passes over Screen 28, contained in Frame 27 while positioned over Textured Surface 29. It can be seen that the separate fingers of the comb-like squeegee, seek alternately the plateaus and valleys encountered throughout its width. Paint 26, carried by Squeegee Blade 12 passes through the screen to cover the plateaus and valleys by individual finger pressures.

What is claimed is:

1. An applicator for applying a viscous medium to a surface, said applicator comprising, in combination, (a) a squeegee blade, the working edge of which bears a plurality of closely-spaced slits perpendicular to the plane of said blade; (b) a relatively rigid body member receiving the non-working edge of said blade; and (c) a bar mounted on said body member and bearing against and extending across the upper surface of said blade, said bar being capable of being moved toward the working edge of said blade.

2. An applicable as defined by claim 1 including handle means extending from said body member in a direction substantially opposite from the working edge of said blade.

3. An applicator as defined by claim 2 including means integral with said bar and extending rearwardly therefrom toward the forward portion of said handle means, whereby said bar can be advanced toward the working edge of said blade by pressure exerted against the rear end of said means.

4. An applicator as defined by claim 3 wherein the rear portion of said handle means extends downwardly at an angle to the plane of said body member.

5. An applicator for applying a viscous medium to smooth or irregular surfaces, said applicator comprising, in combination:

(a) An elongated, flexible resilient blade, the working edge of which bears a multiplicity of closely spaced slits perpendicular to the plane of said blade;

(b) an elongated body member receiving the non-working edge of said blade;

(c) a substantially rigid bar slideably mounted on said body member and bearing against and extending across the upper surface of said blade;

(d) at least one rigid member, integral with said bar, extending rearwardly therefrom whereby said bar can be advanced toward the working edge of said blade by applying pressure to the rear end of said member; and (e) an elongated handle extending rearwardly from said body member at an angle to the plane of said body member.

* * * * *